US008083002B1

(12) United States Patent
Golinveaux et al.

(10) Patent No.: US 8,083,002 B1
(45) Date of Patent: Dec. 27, 2011

(54) COMBUSTIBLE CONCEALED SPACE SPRINKLER SYSTEM AND METHOD

(75) Inventors: James E. Golinveaux, N. Kingstown, RI (US); Mark E. Fessenden, Warwick, RI (US); Kevin D. Maughan, N. Kingstown, RI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 12/106,972

(22) Filed: Apr. 21, 2008

Related U.S. Application Data

(60) Provisional application No. 60/974,385, filed on Sep. 21, 2007, provisional application No. 60/953,324, filed on Aug. 1, 2007, provisional application No. 60/947,781, filed on Jul. 3, 2007, provisional application No. 60/912,784, filed on Apr. 19, 2007.

(51) Int. Cl.

| | |
|---|---|
| ***A62C 2/00*** | (2006.01) |
| ***A62C 3/00*** | (2006.01) |
| ***A62C 35/00*** | (2006.01) |
| ***B05B 3/00*** | (2006.01) |

(52) U.S. Cl. ..... 169/46; 169/45; 169/16; 169/54; 169/56; 239/208

(58) Field of Classification Search ..... 169/5, 16, 169/17, 18, 46, 47, 19, 20, 37, 38, 43, 54, 169/56, 60, 61; 239/208
See application file for complete search history.

(56) References Cited

U.S. PATENT DOCUMENTS

| | | | | |
|---|---|---|---|---|
| 3,180,422 | A * | 4/1965 | Kelley | 169/23 |
| 3,834,462 | A * | 9/1974 | Orloff et al. | 169/17 |
| 4,136,740 | A * | 1/1979 | Groos et al. | 169/39 |
| 5,669,449 | A * | 9/1997 | Polan et al. | 169/16 |
| 6,454,017 | B1 * | 9/2002 | Fischer et al. | 169/37 |
| 6,615,927 | B1 * | 9/2003 | Kim | 169/37 |
| 7,487,841 | B1 * | 2/2009 | Gonci | 169/16 |
| 2007/0221388 | A1 * | 9/2007 | Johnson | 169/16 |

OTHER PUBLICATIONS

Tyco Fire and Building Products, Model CC2-4.2 and 5.6 K-factor Combustible Concealed Space Sprinklers Specific Application, Upright, Dated Mar. 2005, Published on Tyco-Fire.com on Jul. 8, 2005, Whole Document.*

Tyco Fire Products, Moddel CC1 & CC2 Combustible Concealed Space Sprinklers Specific Application, Upright, Copyright 2004, published on Tyco-Fire.com on Jul. 8, 2005, Whole Document.*

Tyco Fire & Building Products; "Application: The Use of Specific Application Sprinklers for Protecting Attics"; Dec. 2007; which is available at Internet<URL:http://tyco-fire.com/TFP_common/AtticSpecApp2.pdf>; 92 pages; Roger S. Wilkins; USA.

Tyco Fire & Building Products; Data Sheet of Models BB, SD, HIP, and AP "Specific Application Sprinklers for Protecting Attics"; Aug. 2007; 28 pages; TFP610; USA.

Tyco Fire & Building Products; Data Sheet of Model CC2-4.2 and 5.6 K-factor Combustible Concealed Space Sprinklers™ Specific Application, Upright; Mar. 2005; 8 pages; TFP632; USA.

NFPA 13—Standard for the Installation of Sprinkler Systems; 2007 edition; Chapter 8 (pp. 13-46 thru 13-92) and Chapter 11 (pp. 13-113 thru 13-118); 55 pages; National Fire Protection Association publication; USA.

* cited by examiner

*Primary Examiner* — Dinh Nguyen
*Assistant Examiner* — Justin Jonaitis
(74) *Attorney, Agent, or Firm* — Perkins Coie LLP

(57) ABSTRACT

Methods and systems of fire protection of an attic space having a sloped roof above a ceiling deck so as to define a concealed space defining a protection area. The method includes disposing at least one upright sprinkler having a deflector disposed beneath the roof and coupled to either a wet or a dry pipe system and defining a hydraulic demand of the at least one sprinkler as being equivalent to a hydraulic demand for the protection area so as to eliminate any increase in the hydraulic design area for the sloped roof.

27 Claims, 7 Drawing Sheets

COMBUSTIBLE CONCEALED SPACE SPRINKLER SYSTEM AND METHOD

PRIORITY DATA AND INCORPORATION BY REFERENCE

The instant application claims the benefit of priority to (i) U.S. Provisional Patent Application No. 60/912,784, filed Apr. 19, 2007; (ii) U.S. Provisional Patent Application No. 60/947,781, filed Jul. 3, 2007; (iii) U.S. Provisional Patent Application No. 60/953,324 filed Aug. 1, 2007; and (iv) U.S. Provisional Patent Application No. 60/974,385, filed Sep. 21, 2007, each of which is incorporated by reference. Further incorporated by reference in its entirety is TYCO FIRE & BUILDING PRODUCTS publication entitled, "Application: The Use of Specific Application Sprinklers for Protecting Attics" (December 2007), which is available at Internet: <URL: http://tyco-fire.com/TFP_common/AtticSpecApp2.pdf>.

TECHNICAL FIELD

This invention relates generally to fire protection systems and methods. More specifically, the invention is a combustible concealed space fire protection sprinkler system and the method of providing such a system.

BACKGROUND OF THE INVENTION

Concealed space conditions can be configured, as provided in NFPA 13 (2007) Chapter 8, Section 8.6, including Table 8.6.2.2.1(a) and FIGURE 8.6.4.1.4, which is incorporated by reference in its entirety, as an attic beneath a roof or ceiling with the combustible concealed space being of wood joist or wood truss construction with truss members three feet or less on center and a slope or pitch of 4 in 12 (rise over run) or greater. NFPA-13 (2007) Section 11.2.3.2.4, which is incorporated by reference in its entirety, provides that for sloped ceilings, the area of sprinkler operation (design area) shall be increased by 30% without revising the density for sprinklers used on sloped ceilings with a pitch exceeding 1 in 6 in non-storage applications. The density requirement of a concealed space system can be determined under the light hazard density/area curve of FIGURE 11.2.3.1.1 of NFPA-13 (2007) which is incorporated by reference in its entirety. Currently under NFPA-13 (2007) at Table 8.6.2.2.1(a), which is incorporated by reference in its entirety, the minimum pressure for a concealed space sprinkler system is 20 pounds per square inch (psi).

NFPA-13 Section 11.2.3.2.5 provides that for a dry system, the sprinkler operation area be increased by 30% over the wet system design requirements without revising the density. Thus, known dry combustible concealed space fire protection systems beneath a sloped ceiling or roof are subject to a 30% penalty for the dry system and the additional 30% penalty for sloped ceiling requirements.

SUMMARY OF THE INVENTION

Provided is a preferred method of fire protection of an attic space having a sloped roof above a ceiling deck so as to define a concealed space having an occupancy classification therebetween having a protection area of no greater than 3,000 square feet (sq. ft.). The method includes disposing at least one upright sprinkler having a deflector disposed beneath the roof and coupled to a wet pipe system and defining a hydraulic demand of the at least one sprinkler as being equivalent to a hydraulic demand for the protection area. Accordingly, the preferred method provides that the hydraulic demand of the sprinklers is satisfied by the hydraulic demand of just the protection area, or more specifically, the density requirement multiplied by the hydraulic design or protection area or more specifically the horizontal foot print of the sloped roof. The preferred method of fire protection using the preferred sprinklers does not require that the hydraulic design area be increased by thirty percent to account for the sloped roof, as provided in NFPA-13 (2007) Section 11.2.3.2.4. Thus, the inventor has discovered that application of the preferred special application sprinklers, provides for a preferred combustible concealed space fire protection system that eliminates current hydraulic design "penalties" for sloped ceiling sprinkler designs, and thereby reduces the water demand required under the current sloped ceiling design standards.

In the case where there is more than one row of sprinklers beneath the sloped roof, another preferred embodiment of the method includes providing a staggered sprinkler configuration of preferred sprinklers so as to present a protection area having a hydraulically demand that is at least equal to that of a standard spray sprinkler configuration under a flat ceiling. Thus, the preferred system eliminates the need to design the system with the 30% increase in the operational area beneath a sloped ceiling.

The methods described herein are applicable to a preferred combustible concealed space fire protection system configured as either a dry system or a wet system. Thus the sprinklers can be installed and located in a method as described above for coupling to a dry pipe system. Because the preferred method avoids the design penalty imposed for a system beneath a sloped ceiling, the preferred method of fire protection is only subject to a 30% design area increase when designed, for example, as a dry combustible concealed space fire protection system. Thus, where known dry combustible concealed space fire protection systems are beneath a sloped ceiling or roof, they are subject to a 30% penalty for the dry system and the additional 30% penalty for sloped ceiling requirements. The preferred method of dry combustible concealed space fire protection instead is only subject to the dry system design penalty.

Another preferred method is provided for protecting an attic space having a roof above a ceiling so as to define a concealed space therebetween having a protection area of no greater than 3,000 sq. ft, the roof being sloped and defined by a slope or pitch preferably ranging from about 3 in 12 to about 12 in 12. The method includes installing a first pair of sprinklers spaced apart along a first row perpendicular to the slope with a distance of no more than 10 feet therebetween, and installing at least a second pair of sprinklers spaced apart along a second row perpendicular to the slope with a distance of no more than 10 feet therebetween. The second row are spaced parallel to the first row at a distance of no more than 12 feet, and the second pair of sprinklers are offset from the first pair of sprinklers such that in the direction of the slope, one sprinkler of the second pair is preferably aligned preferably at the midpoint distance between first pair of sprinklers. Installing the first pair at the at least second pair of sprinklers further includes installing upright sprinklers having a deflector oriented to the slope and defining a coverage area of up to maximum 120 square feet. The preferred methodology provides fire protection systems beneath a sloped roof or ceiling without the penalties previously required.

BRIEF DESCRIPTIONS OF THE DRAWINGS

The accompanying drawings, which are incorporated herein and constitute part of this specification, illustrate exemplary embodiments of the invention, and, together with the description given above, serve to explain the features of the invention.

DETAILED DESCRIPTION

Figure 1:
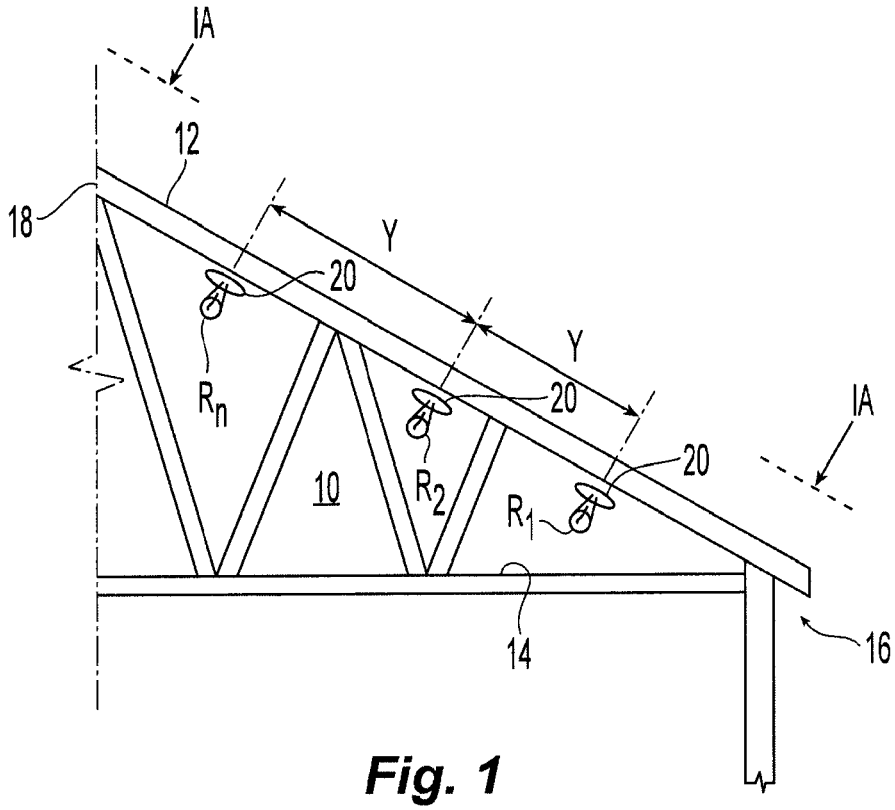
FIG. 1 is a schematic elevation view of a system having a preferred staggered sprinkler spacing.
Figure 1A:
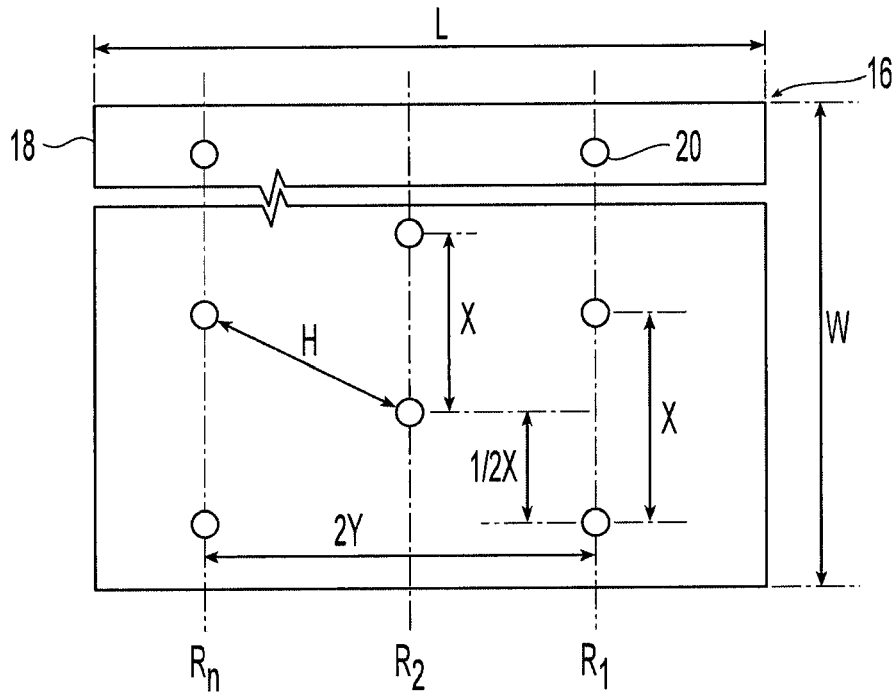
FIG. 1A is a schematic plan view of the system of FIG. 1 illustrating a preferred staggered sprinkler spacing.
Figure 1B:
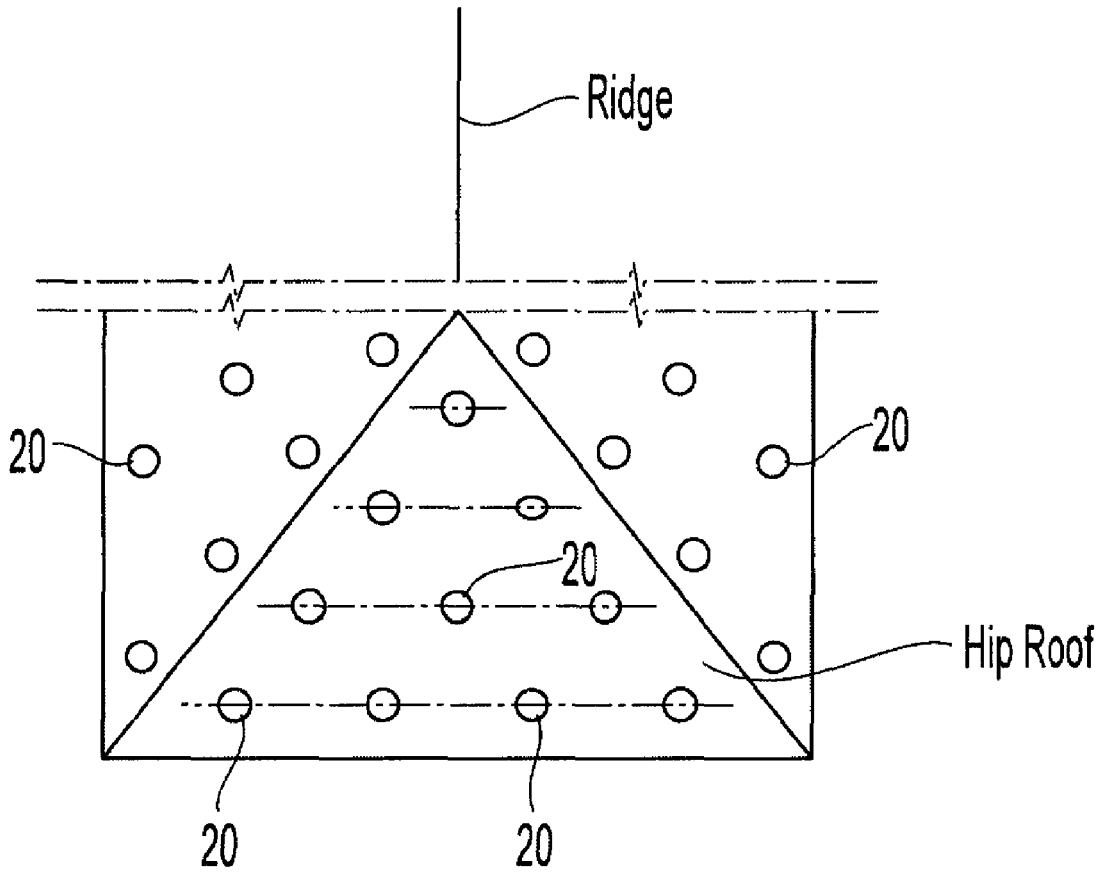
FIG. 1B is a schematic plan view of the another preferred system of FIG. 1 illustrating a preferred staggered sprinkler spacing.

Shown in FIGS. 1-1B are schematic embodiments of preferred methods for providing fire protection to an attic space, for example, a non-combustible or combustible concealed space beneath a roof. The preferred method includes locating a plurality of specific application sprinklers, preferably four or more, spaced about a sloped ceiling having a slope of 3 in 12 or greater and more preferably ranging from about 3 in 12 to about 12 in 12. The preferred method adequately provides wet or dry fire protection to the concealed space, yet avoids the hydraulic design penalties imposed by NFPA 13 for design of a sprinkler system beneath a sloped ceiling and further for designing a dry pipe system.

Shown in FIG. 1 is an elevation view of a concealed space 10 defined between a roof 12 and a floor 14. The concealed space conditions can be configured, as provided in NFPA 13 (2007) Chapter 8, Section 8.6, including Table 8.6.2.2.1(a) and FIGURE 8.6.4.1.4 which is incorporated by reference in its entirety, as an attic beneath the roof 12 with the combustible concealed space 10 being of wood joist or wood truss construction with truss members three feet or less on center. The roof 12 preferably extends between an eave 16 and a ridge 18 on an incline so as to define a slope having a pitch of 3 in 12 or greater and more preferably ranging from about 3 in 12 to about 12 in 12.

The combustible concealed space 10 preferably defines an area to be protected that is no greater than three thousand square feet (3,000 sq. ft.). In addition, the preferred space is further preferably separated from any other similarly configured combustible concealed space by a distance of fifteen feet (15 ft.) of area that is protected by back-to-back (BB), single direction (SD), and/or ridge or roof (HIP) sprinklers (collectively "attic sprinklers), which are shown and described in TYCO FIRE & BUILDING PRODUCTS publication Data Sheet TFP610, entitled "Models BB [Back to Back], SD [Single Directional], HIP and AP Specific Application 'Sprinklers for Protecting Attics'" (August 2007) which is incorporated by reference in its entirety.

Figure 2:
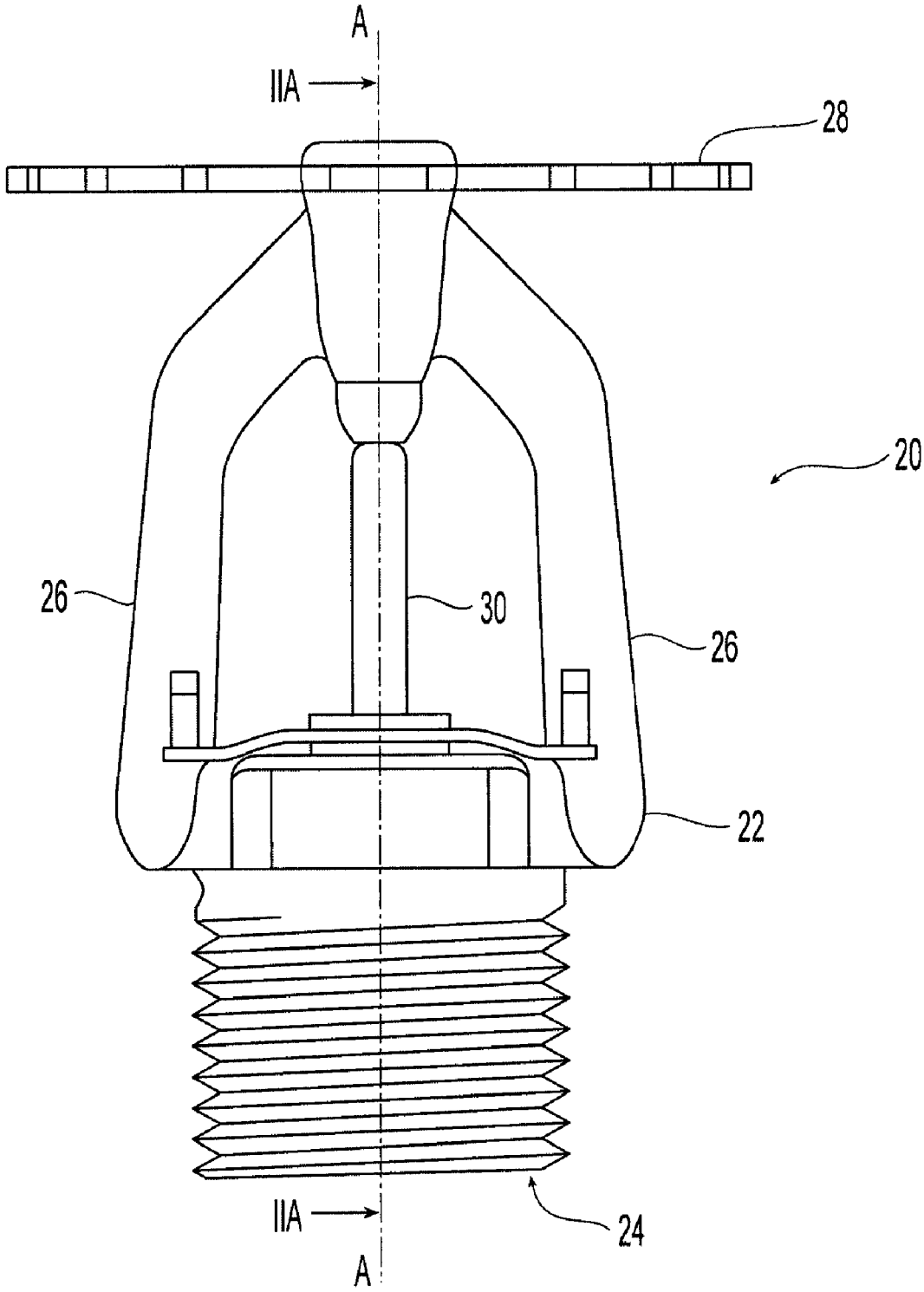
FIGS. 2-2A are elevation and cross-sectional views of a preferred sprinkler for use in the system of FIGS. 1-1A.
Figure 2A:
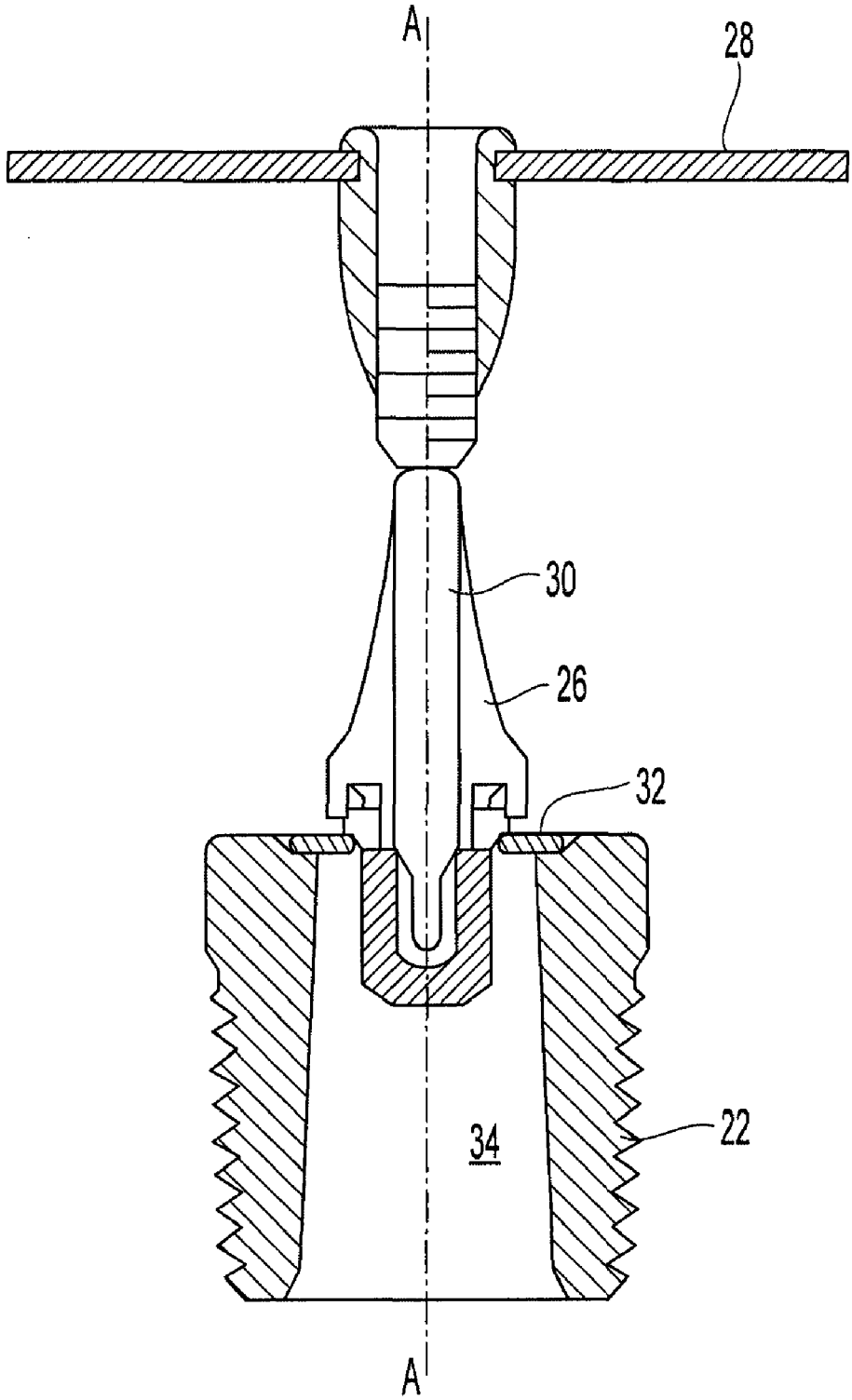
Figure 5:
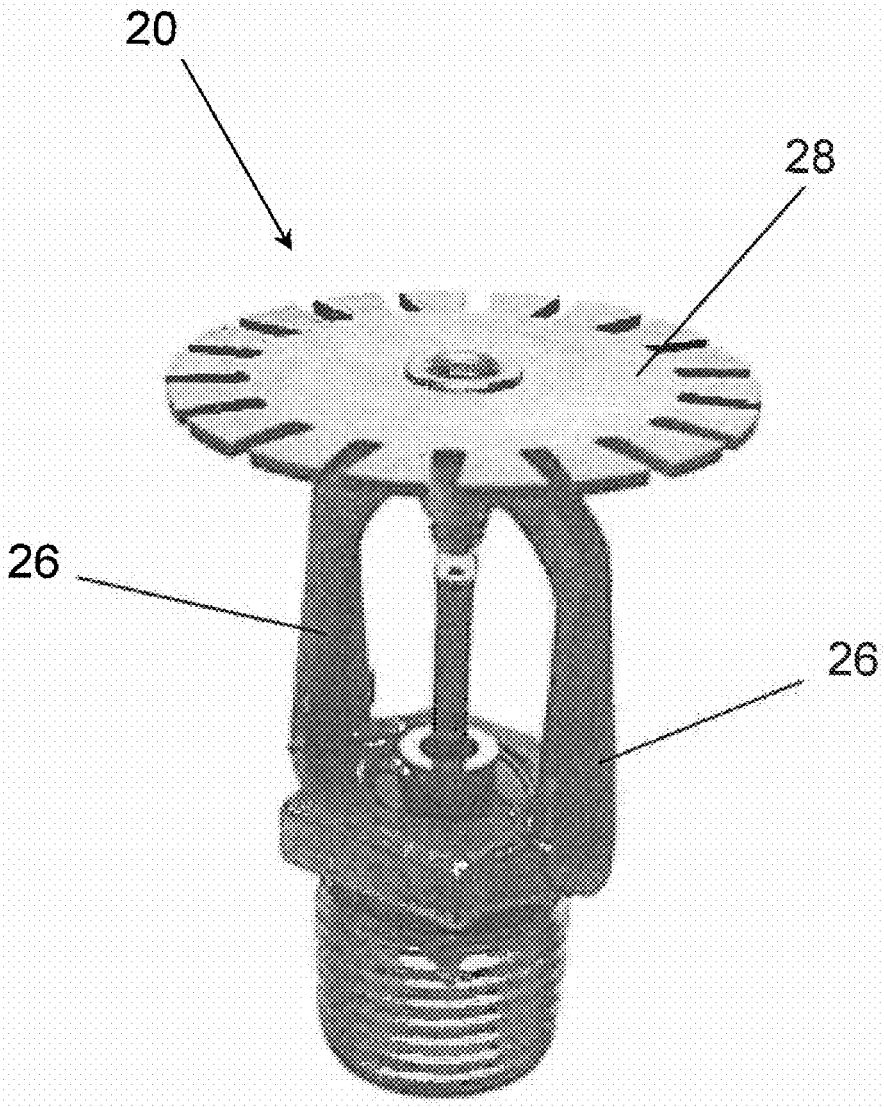
FIG. 5 is a perspective view of a preferred sprinkler for use in the system of FIGS. 1-1A.

Disposed beneath the roof 12 are one or more rows of sprinklers 20 spaced relative to one another along the slope parallel to the roof 12. The sprinklers 20 are preferably combustible concealed spaced specific application upright sprinklers "Model AP with 4.2 and 5.6 K-Factor Specific Application Combustible Concealed Space Sprinklers" from Tyco Fire & Building Products, as shown and described in Data Sheet TFP610 which is incorporated by reference in its entirety. Shown in FIGS. 2, 2A, and 5 are plan, cross-sectional, and perspective views of the sprinkler 20. The sprinkler includes a frame 22 with a threaded inlet end 24 for coupling to a branch line of one of a wet pipe or dry pipe system. The frame 22 includes a pair of frame arms 26 that extend distally to support a deflector 28 disposed centrally along the sprinkler axis A - - - A. The deflector 28 is a substantially flat planar circular member having a plurality of radial slots defining a plurality of tines therebetween. In the preferred installation of the sprinkler 20 beneath the roof 12, the sprinkler axis A . . . A is preferably perpendicular to the roof 12 such that the deflector 28 is substantially parallel to the slope of the roof 12 and one to three inches below the bottom of the top chord or bottom of the solid wood rafter of the roof 12. Actuation of the sprinkler 20 is controlled by a thermally sensitive bulb 30 which supports a seal assembly 32 disposed in the passageway 34 to control fluid discharge from the sprinkler 10. The passageway 34 can be appropriately dimensioned to define the K-Factor being one of 4.2 GPM/$(PSI)^{1/2}$ and 5.6 GPM/$(PSI)^{1/2}$.

The sprinkler 20 and its bulb 30 are preferably rated for 200° F. Upon exposure to a sufficient level of heat, the bulb 30 shatters to actuate the sprinkler and release the seal assembly 32. Fluid is discharged from the sprinkler outlet to impact the deflector 28 for distribution over the protection area. The sprinkler 20 and its deflector 28 define a substantially circular cylindrical spray pattern in which water deflected off the peripheral edge of the deflector in a substantially horizontal manner. The sprinkler 20 and its deflector 28 define a preferred maximum coverage area of about 120 square feet. Moreover, the sprinkler 20 defines a minimum operating pressure of about 7 psi. Accordingly, for the K-Factors of 4.2 GPM/$(PSI)^{1/2}$ and 5.6 GPM/$(PSI)^{1/2}$, the sprinkler 20 defines respectively, flow rates of 11.1 GPM and 14.8 GPM.

Referring again to FIG. 1, the first row R1 along the eave 16 of sprinklers is preferably located in accordance with NFPA 13 (2007) Paragraph 8.6.4.1.4.3 so as to be at a minimum five feet from the intersection of the truss chords, or the wood rafters and ceiling joints. Where more than one row of sprinklers is required for protection of the space 10, the rows are preferably equidistantly spaced. Preferably, the rows R1, R2 . . . Rn are spaced in the direction of the slope at a maximum row-to-row spacing ranging from a distance Y of about ten feet to about twelve feet (10 ft.-12 ft.) and is more preferably twelve feet (12 ft.). Referring to FIG. 1A is a plan view of the concealed space 10 with the spaced apart rows of sprinklers 20. For any given row, the of sprinklers 20 are preferably linearly and preferably evenly spaced along the length of the eave 16 perpendicular to the slope. The sprinklers 20 are further preferably linearly spaced from one another at a distance X along the row at minimum distance X of about seven feet (7 ft.) to a maximum of about ten feet (10 ft.).

Referring again to FIG. 1A, shown is the horizontal footprint projection of the sloped roof 12 onto the deck 14 which defines the protection area 10 having a length L and a width W up to the maximum area for the preferred protection of 3000 square feet. Disposed over the area 10 is the preferred array of sprinklers 20. According to the preferred method, where there is more than one row R required, the sprinklers are staggered. More specifically, for a first row R1 having at least two sprinklers 20*a* and 20*b* spaced apart at a distance X along the row R1, the method provides an adjacent second row R2 having at least two sprinklers 20*b* and 20*c* spaced apart at a distance X where one of the two sprinklers of the second row R2 is aligned in the direction of the slope with the mid-point between the at least two sprinklers 20*a* and 20*b* of the first row R1. Shown in FIG. 1B is an alternative schematic embodiment of the preferred staggered method in which the sloped roof 12 is in a HIP roof system.

In a more specific alternative method of protection, sprinklers 20 are spaced at a distance X every five feet (5 ft.) and the rows are spaced apart a distance Y every ten feet (10 ft.) between sprinklers. Accordingly, equidistantly between every two sprinklers of one row is a sprinkler 20 on an adjacent row. Each of the preferred sprinklers in such an arrangement preferably defines a protection area of at least 36 square feet.

Figure 3:
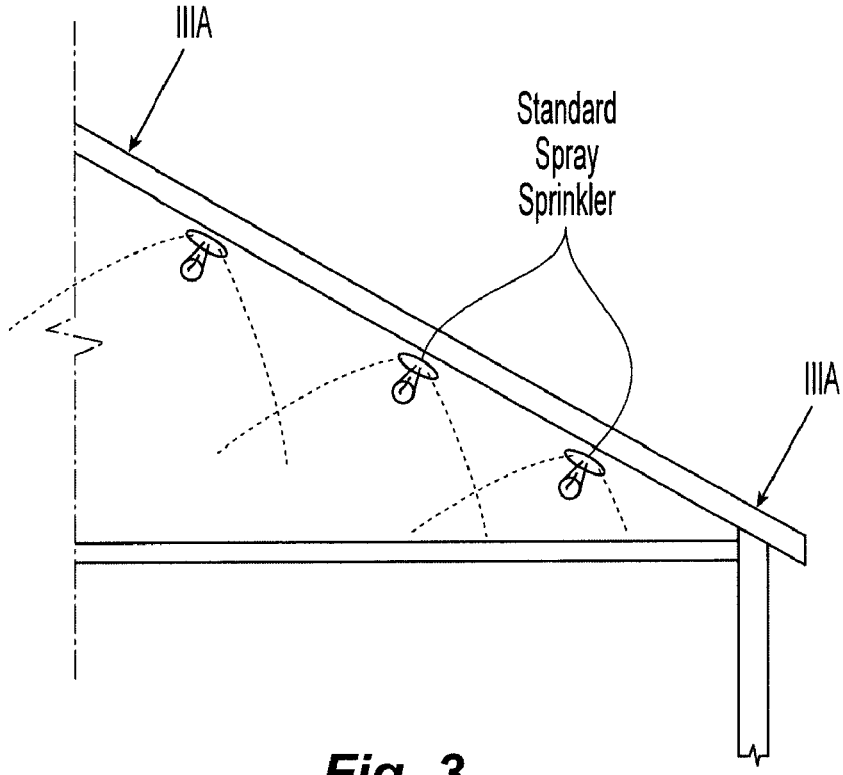
Fig. 3 (Prior Art)
FIGS. 3-3A are an elevation and plan schematic of the spray pattern in a known system using standard sprinklers in a known grid spacing.
Figure 3A:
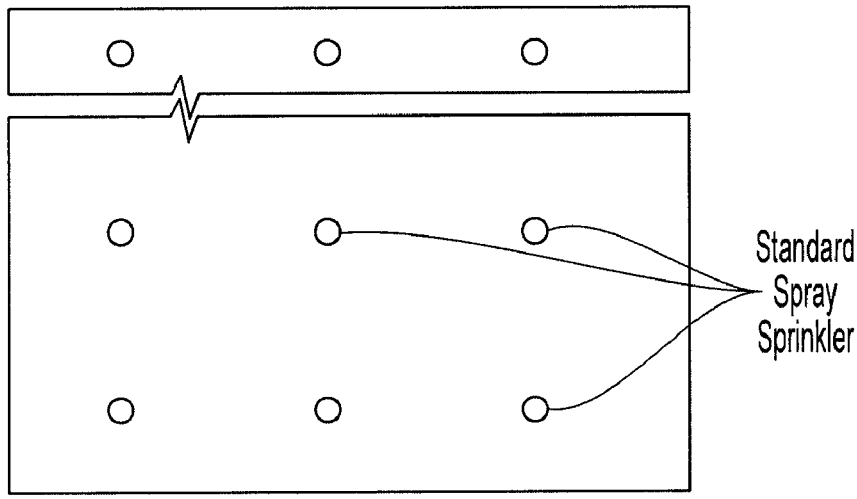
Fig. 3A (Prior Art)
Figure 4:
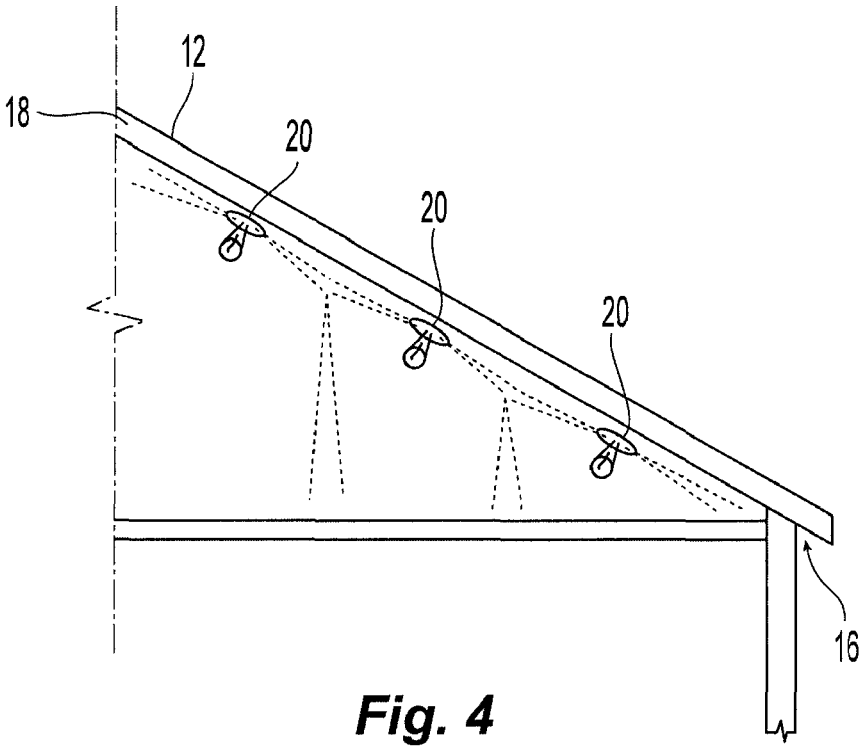
FIG. 4 is an partial elevation schematic of the spray pattern in a the system of FIGS. 1-1A.
Figure 4A:
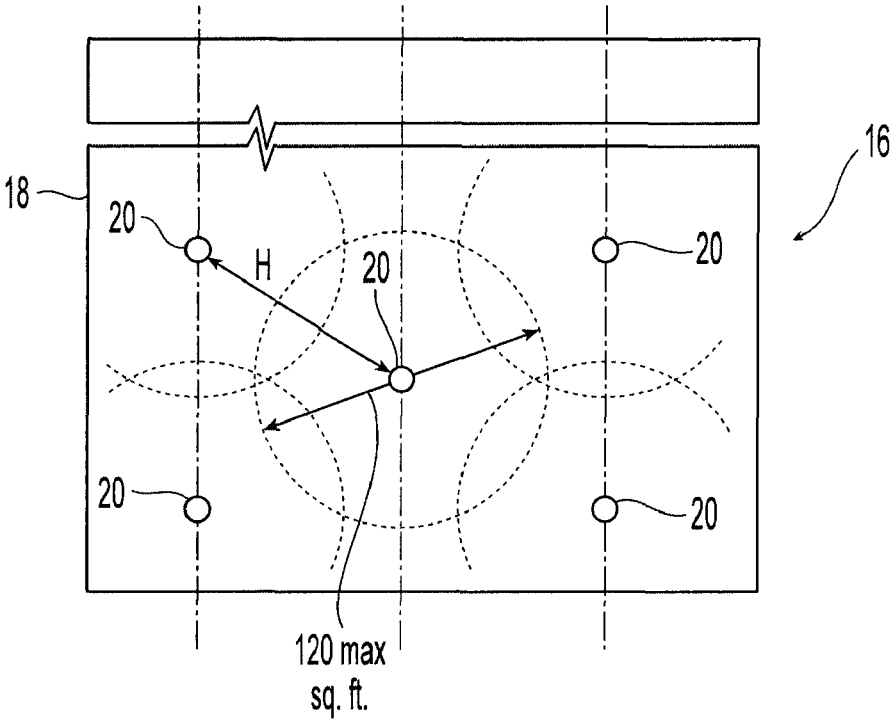
FIG. 4A is an partial plan schematic of the spray pattern in a the system of FIG. 1-1A.

Standard spray sprinklers present an umbrella-type spray pattern in which there is a v-shaped void between overlapping patterns and the roof 12 through which can travel and migrate, as seen for example, in FIGS. 3-3A. The preferred sprinklers 20 however minimize such voids because, the circular cylindrical spray pattern of the sprinklers 20, each having a coverage area of 120 square feet, overlap one another without formation of a v-shaped void, as schematically illustrated in FIGS. 4 and 4A.

The preferred method of staggered sprinkler spacing seeks to minimize or otherwise eliminate the possibility that heat from a fire would progress up the sloped roof 12 to the ridge 18 without activation of at least one sprinkler 20. Thus, should the heat travel between two sprinklers of one row, the heat would engage and actuate a sprinkler 20 on the next adjacent row up the slope of the roof 12. In addition, the preferred method of staggering the sprinklers 20 places the sprinkler-to-sprinkler centers a sufficient distance apart H, as seen schematically in FIGS. 1A and 4A, so as to minimize or eliminate the possibility of cold soldering of adjacent sprinklers.

The preferred method includes determining the hydraulic demand of the sprinklers 20 in the protection of the concealed space 10 beneath the sloped roof 12. Preferably, the hydraulic demand is determined using the Density/Area curve for light hazard as shown in FIGURE 11.2.3.1.1 of NFPA-13 (2007) which is incorporated by reference in its entirety. According to the curve, the hydraulic density requirement is 0.10 GPM/SQ. FT. for a sprinkler operational or coverage area of 1500 SQ. FT. or less. For the preferred method and arrangement of sprinklers 20, the hydraulic demand of the sprinklers 20 to be satisfied is the hydraulic demand of just the protection area, or more specifically, the density requirement, i.e., 0.10 GPM/SQ. FT. multiplied by the hydraulic design or protection area or more specifically the horizontal foot print of the sloped roof and the protection area of the sprinklers 20. The preferred method of fire protection using the preferred sprinklers 20 does not require that the hydraulic design area be increased by thirty percent to account for the sloped roof, as provided in NFPA-13 (2007) Section 11.2.3.2.4. Thus, the inventor has discovered that application of the preferred special application sprinklers, provides for a preferred concealed space fire protection system that eliminates current hydraulic design "penalties" for sloped ceiling sprinkler designs, and thereby reduces the water demand required under the current sloped ceiling design standards. This system is provided by the method of disposing at least one upright sprinkler 20 having a deflector disposed beneath the roof and coupled to a pipe system and defining a hydraulic demand of the at least one sprinkler as being equivalent to a hydraulic demand for the protection area, thus eliminating any current "penalty" for designing beneath a sloped roof or ceiling. Accordingly, the preferred method provides that the hydraulic demand of the sprinklers is satisfied by the hydraulic demand of just the protection area, or more specifically, the density requirement multiplied by the hydraulic design or protection area or more specifically the horizontal foot print of the sloped roof 12.

In the case where there is more than one row of sprinklers 20, the staggered sprinkler configuration of the special application sprinklers in the preferred combustible concealed space fire protection system presents a protection area having a hydraulically demand that is at least equal to that of a standard spray sprinkler configuration under a flat ceiling. Thus, the preferred system eliminates the need to design the system with a 30% increase in the operational area beneath a sloped ceiling. Where, for example, the sprinkler spacing in a preferred wet system defines a protection area of about 1500 square feet, the sprinkler operational area remains 1500 square feet for use in the hydraulic demand determination.

The methods described herein are applicable to a preferred combustible concealed space fire protection system configured as a either a dry system or a wet system. Thus the sprinklers can be installed and located in a method as described above for coupling to either a wet pipe system or a dry pipe system. NFPA-13 Section 11.2.3.2.5 provides that for a dry system the sprinkler operation area be increased by 30% over the wet system design requirements without revising the density. Because the preferred method and system avoids the design penalty imposed for a system beneath a sloped ceiling, the preferred method of fire protection is only subject to a 30% design area increase when designed as a dry combustible concealed space fire protection system. Thus, for example, where known dry combustible concealed space fire protection systems are beneath a sloped ceiling or roof to define a sprinkler spacing of, for example, 1500 square feet, they are subject to a 30% penalty for the dry system and the additional 30% penalty for sloped ceiling requirements so as to bring the hydraulic demand area to 2535 square feet ((1500 sq. ft.*1.3)*1.3)=2535 sq. ft.). A preferred dry combustible concealed space fire protection system according to the preferred method instead is only subject to the dry system design penalty and therefore defines a hydraulic demand area of only 1950 square feet.

Moreover, the hydraulic demand calculations for the preferred system are a function of only the area being protected by the preferred specific application sprinklers, regardless of whether other areas are being protected by attic sprinklers. Thus, for example, where an area being protected by TYCO FIRE PRODUCTS MODEL AP SPRINKLERS fire protection sprinklers defines a minimum protection area of, for example, 800 square feet, the hydraulic demand calculation for the area protected by the MODEL AP SPRINKLERS fire protection sprinklers using a method such as the density/area method of Chapter 11 in NFPA-13 (2007) for light hazard, only requires an accounting of the 800 square foot area protected by the MODEL AP SPRINKLERS fire protection sprinklers and not any area protected by attic sprinklers.

In another aspect of the preferred concealed space sprinkler system, the inventor has found that where the sprinkler spacing in a direction perpendicular to the slope of the ceiling or roof is greater than eight feet (8 ft.), the minimum operating pressure for each preferred sprinkler in the system is less than twenty pounds per square inch (20 psi.). Currently under NFPA-13 (2007) at Table 8.6.2.2.1(a), which is incorporated by reference in its entirety, the minimum pressure for such a sprinkler spacing and concealed space configuration is 20 psi. A preferred concealed space system more preferably defines a minimum operating pressure of 7 psi. in which the preferred sprinklers have a sprinkler-to-sprinkler spacing greater than 8 feet in a direction perpendicular to the slope.

While the present invention has been disclosed with reference to certain embodiments, numerous modifications, alterations, and changes to the described embodiments are possible without departing from the sphere and scope of the present invention. Accordingly, it is intended that the present invention not be limited to the described embodiments, but that it has the full scope defined by the language of the following claims, and equivalents thereof.

What is claimed is:

1. A method of fire protection of an attic space having a roof above a ceiling deck so as to define a concealed space having an occupancy classification therebetween with a protection area of no greater than 3,000 sq ft., the method comprising:

defining the protection area as being equivalent to a horizontal footprint area as defined by the sloped roof, the roof being sloped with a pitch exceeding 1 in 6;

disposing at least one upright sprinkler having a deflector disposed beneath the sloped roof and coupled to a pipe system, the deflector providing a spray pattern that is substantially circular cylindrical about the at least one upright sprinkler; and defining a hydraulic demand of the at least one upright sprinkler being based on a hydraulic design area equivalent to the horizontal footprint such that the hydraulic demand does not require that the hydraulic design area be increased to account for the sloped roof.

2. The method of claim 1 wherein the disposing at least one upright sprinkler coupled to the pipe system includes the sprinkler coupled to a dry pipe system.

3. The method of either one of claims 1 and 2, wherein disposing the at least one upright sprinkler includes installing TYCO MODEL AP SPECIFIC APPLICATION COMBUSTIBLE CONCEALED SPACE SPRINKLER fire protection sprinklers.

4. The method of either one of claims 1 and 2, wherein the disposing the at least one sprinkler includes orienting the deflector parallel to the roof.

5. The method of either one of claims 1 and 2, wherein providing the spray pattern includes defining a sprinkler coverage area of about 120 square feet.

6. The method of either one of claims 1 and 2, wherein the disposing of the at least one upright sprinkler includes disposing a plurality of upright sprinklers defining a sprinkler-to-sprinkler spacing of the at least one sprinkler to an adjacent sprinkler as having a maximum spacing of twelve feet (12 ft.) in the direction of the slope and a maximum spacing of ten feet (10 ft.) in the direction perpendicular to the slope.

7. The method of either one of claims 1 and 2, wherein the disposing of the at least one upright sprinkler includes disposing a plurality of upright sprinklers defining a sprinkler-to-sprinkler spacing of the at least one sprinkler to an adjacent sprinkler as having a minimum spacing of seven feet (7 ft.) in the direction perpendicular to the slope.

8. The method of either one of claims 1 and 2, wherein the defining a hydraulic demand includes providing a density of 0.1 GPM/SQ. FT.

9. A method of protecting an attic space having a sloped roof above a ceiling so as to define a concealed space therebetween having a protection area of no greater than 3,000 sq. ft., the method comprising:

installing a first pair of sprinklers spaced apart along a first row perpendicular to the direction of the roof slope with a distance of no more than 10 feet therebetween, the slope of the roof being 3 in 12 or greater;

installing at least a second pair of sprinklers spaced apart along a second row perpendicular to the slope with a distance of no more than 10 feet therebetween, the second row being spaced parallel to the first row at a distance of no more than 12 feet; the second pair of sprinklers being offset from the first pair of sprinklers such that in the direction of the slope, one sprinkler of the second pair is aligned at the midpoint distance between first pair of sprinklers;

the installing the at least first and second pair of sprinklers includes installing upright sprinklers to satisfy a hydraulic demand of the at least first and second pair of sprinklers based on a hydraulic design area being equivalent to a horizontal footprint of the sloped roof, the slope being 3 in 12 or greater such that the hydraulic demand does not require that the hydraulic design area be increased to account for the sloped roof, each of the upright sprinklers having a deflector oriented to the slope and defining a coverage area of up to a maximum 120 square feet, the deflector providing a spray pattern that is substantially circular cylindrical about the upright sprinkler.

10. The method of claim 9, wherein the installing upright sprinklers includes installing TYCO MODEL AP SPECIFIC APPLICATION COMBUSTIBLE CONCEALED SPACE SPRINKLER fire protection sprinklers.

11. The method of claim 9, wherein the installing the upright sprinklers includes orienting the deflector parallel to the roof.

12. The method of claim 9, wherein providing the spray pattern includes defining a sprinkler coverage area of about 120 square feet.

13. The method of claim 9, wherein installing the at least second pair includes spacing the second row from the first row at a minimum spacing of seven feet (7 ft.) in the direction perpendicular to the slope.

14. The method of claim 9, wherein the defining a hydraulic demand includes providing a density of 0.1 GPM/SQ. FT.

15. A system for fire protection of an attic space having a sloped roof above a ceiling deck so as to define a concealed space having an occupancy classification therebetween with a protection area of no greater than 3,000 sq. ft., the system comprising:

at least one upright sprinkler having a deflector disposed beneath the sloped roof, the roof being sloped with a pitch exceeding 1 in 6, the deflector providing a spray pattern that is substantially circular cylindrical about the at least one upright sprinkler; and a pipe system coupled to the at least one sprinkler to satisfy a hydraulic demand for the at least one sprinkler being based on a hydraulic design area equivalent to a horizontal foot print defined by the sloped roof such that the hydraulic demand does not require that the hydraulic design area be increased to account for the sloped roof.

16. The system of claim 15, wherein the pipe system coupled to the at least one sprinkler is a dry pipe system.

17. The system of either one of claims 15 and 16, wherein the at least one upright sprinkler includes installing TYCO MODEL AP SPECIFIC APPLICATION COMBUSTIBLE CONCEALED SPACE SPRINKLER fire protection sprinklers.

18. The system of either one of claims 15 and 16, wherein the deflector is oriented parallel to the roof.

19. The system of either one of claims 15 and 16, wherein the at least one sprinkler defines a sprinkler coverage area of about 120 square feet.

20. The system of either one of claims 15 and 16, wherein the at least one upright sprinkler include a plurality of upright sprinklers defining a sprinkler-to-sprinkler spacing to an adjacent sprinkler, the spacing having a maximum twelve feet (12 ft.) in the direction of the slope and a maximum spacing of ten feet (10 ft) in the direction perpendicular to the slope.

21. The system of either one of claims 15 and 16, wherein the at least one upright sprinkler include a plurality of upright sprinklers defining a sprinkler-to-sprinkler spacing to an adjacent sprinkler, the spacing having a minimum spacing of seven feet (7 ft.) in the direction perpendicular to the slope.

22. The system of either one of claims 15 and 16, wherein the hydraulic demand provides a density of 0.1 GPM/SQ. FT.

23. A system for providing fire protection to an attic space having a sloped roof above a ceiling so as to define a concealed space therebetween with a protection area of no greater than 3,000 sq. ft., the installation comprising:

a first pair of sprinklers spaced apart along a first row perpendicular to a direction of the slope of the roof, the slope being 3 in 12 or greater, the first pair of sprinkler being spaced with a distance of no more than 10 feet therebetween;

at least a second pair of sprinklers spaced apart along a second row perpendicular to the direction of the slope with a distance of no more than 10 feet therebetween, the second row being spaced parallel to the first row at a distance of no more than 12 feet; the second pair of sprinklers being offset from the first pair of sprinklers such that in the direction of the slope, one sprinkler of the second pair is aligned at the midpoint distance between first pair of sprinklers to satisfy a hydraulic demand of the first and at least second pair of sprinklers based upon a hydraulic design area equivalent to a horizontal footprint of the sloped roof such that the hydraulic demand does not require that the hydraulic design area be increased to account for the sloped roof;

the first and at least second pair of sprinklers each being, upright sprinklers having a deflector oriented to the slope and defining a coverage area of up to a maximum 120 square feet, the deflector providing a spray pattern that is substantially circular cylindrical about the upright sprinkler.

24. A method of fire protection of an attic space, the method comprising:

disposing a plurality of upright sprinklers, each of the plurality of sprinklers having a deflector disposed beneath a roof being sloped with a pitch exceeding 1 in 6, the deflector providing a spray pattern that is substantially circular cylindrical about the at least one upright sprinkler;

coupling the plurality of upright sprinklers to a pipe system so as to satisfy a hydraulic demand of the plurality of upright sprinklers based on a hydraulic design area equivalent to a footprint determined for the roof being sloped with a pitch of less than 1 in 6, such that the hydraulic demand does not require the hydraulic design area to be increased to account for the sloped roof at the pitch exceeding 1 in 6.

25. The method of fire protection of claim 24, wherein the coupling the plurality of upright sprinklers to the pipe system includes coupling the plurality of upright sprinklers to a dry pipe system.

26. The method of any one of claims 2, 16, and 25, wherein the hydraulic demand is multiplied by 1.3.

27. A method of fire protection of a concealed space, the method comprising:

determining a protection area of the concealed space as being no greater than 3,000 square feet and equivalent to a horizontal footprint area projected by a sloped roof above the concealed space onto a ceiling deck below the concealed space, the sloped roof having a pitch exceeding 1 in 6; and defining a hydraulic demand based on a hydraulic design area to be installed beneath the sloped roof having a deflector to provide a spray pattern over the protection area that is substantially circular cylindrical about the at least one upright sprinkler, the hydraulic design area being equivalent to the horizontal footprint such that the hydraulic demand does not require that the hydraulic design area be increased to account for the sloped roof.

* * * * *